US011400326B2

(12) United States Patent
Zahn et al.

(10) Patent No.: US 11,400,326 B2
(45) Date of Patent: Aug. 2, 2022

(54) EJECTOR NOZZLE AND USE OF THE EJECTOR NOZZLE

(71) Applicant: BASF SE, Ludwigshafen (DE)

(72) Inventors: Volker Michael Zahn, Pearland, TX (US); Robert John Blanchard, Mannheim (DE)

(73) Assignee: BASF SE, Ludwigshafen (DE)

( * ) Notice: Subject to any disclaimer, the term of this patent is extended or adjusted under 35 U.S.C. 154(b) by 0 days.

(21) Appl. No.: 15/741,544

(22) PCT Filed: Jul. 13, 2016

(86) PCT No.: PCT/EP2016/066673
§ 371 (c)(1),
(2) Date: Jan. 3, 2018

(87) PCT Pub. No.: WO2017/009384
PCT Pub. Date: Jan. 19, 2017

(65) Prior Publication Data

US 2018/0193680 A1 Jul. 12, 2018

(30) Foreign Application Priority Data

Jul. 15, 2015 (EP) ..... 15176871

(51) Int. Cl.
*A62C 4/02* (2006.01)
*F04F 5/04* (2006.01)
(Continued)

(52) U.S. Cl.
CPC ..... *A62C 4/02* (2013.01); *B01F 23/2132* (2022.01); *B01F 23/23* (2022.01); *F04F 5/04* (2013.01);
(Continued)

(58) Field of Classification Search
CPC ..... A62C 4/02; F04F 5/04; F04F 5/46; F04F 5/463; B01F 3/04099; B01F 3/04049; B01F 2005/0091
See application file for complete search history.

(56) References Cited

U.S. PATENT DOCUMENTS 1,176,017 A * 3/1916 Armstrong ..... F23D 11/10 239/430
1,290,422 A * 1/1919 Vale ..... F23D 14/82 431/346
(Continued)

FOREIGN PATENT DOCUMENTS

CN 2187492 Y 1/1995
CN 102486085 A 6/2012
(Continued)

OTHER PUBLICATIONS

International Search Report dated Sep. 27, 2016, in PCT/EP2016/066673, filed Jul. 13, 2016.
(Continued)

*Primary Examiner* — Steven M Cernoch
(74) *Attorney, Agent, or Firm* — Grüneberg and Myers PLLC

(57) ABSTRACT

The invention relates to an ejector nozzle having a liquid-carrying duct and a gas-carrying duct. The gas-carrying duct opens into the liquid-carrying duct upstream of an outlet opening. The insert acting as a flame arrester is positioned in the gas-carrying duct. The insert is configured in such a way that no gas can flow around the insert. The invention furthermore relates to use of the ejector nozzle in a jet loop reactor.

16 Claims, 2 Drawing Sheets

(51) Int. Cl.

| | |
|---|---|
| ***F04F 5/46*** | (2006.01) |
| ***B01F 23/23*** | (2022.01) |
| ***B01F 23/213*** | (2022.01) |
| ***B01F 25/00*** | (2022.01) |

(52) U.S. Cl.
CPC ..... *F04F 5/46* (2013.01); *F04F 5/463* (2013.01); *B01F 2025/931* (2022.01)

(56) References Cited

U.S. PATENT DOCUMENTS 3,031,285 A * 4/1962 Hedberg ..... A62C 4/02 137/67
3,035,632 A * 5/1962 Ericsson ..... F23D 14/38 431/249
3,723,545 A * 3/1973 Nagel ..... C07C 29/42 568/855
3,938,738 A 2/1976 Nagel et al.
4,215,081 A * 7/1980 Brooks ..... B01F 3/04517 261/122.1
4,361,420 A * 11/1982 Bell ..... A62C 4/00 431/346
4,397,741 A * 8/1983 Miller ..... B03D 1/1425 209/170
4,444,109 A * 4/1984 Gifford, Jr. ..... A62C 4/00 102/200
4,806,096 A * 2/1989 Kobayashi ..... F23D 14/42 266/48
4,818,220 A * 4/1989 Kobayashi ..... F23D 14/42 431/264
4,997,549 A * 3/1991 Atwood ..... B03D 1/1425 209/164
5,076,469 A * 12/1991 Pleuse ..... B05B 7/1646 165/907
5,098,284 A 3/1992 Van Der Veen
5,192,423 A * 3/1993 Duczmal ..... B03C 1/30 208/391
5,407,348 A * 4/1995 Mims ..... F23D 14/42 137/454.2
5,415,233 A * 5/1995 Roussakis ..... A62C 4/02 169/48
5,470,227 A * 11/1995 Mims ..... F23D 14/42 239/528
5,513,798 A * 5/1996 Tavor ..... B05B 7/0475 239/405
5,726,321 A 3/1998 Bittins et al.
5,832,946 A * 11/1998 Campau ..... H01M 2/362 137/15.08
5,857,323 A * 1/1999 Beveridge ..... F02K 9/52 239/424.5
5,927,312 A * 7/1999 Dryden ..... F16K 13/06 137/1
5,948,945 A 9/1999 Lorenz et al.
6,019,820 A 2/2000 Leverett
6,022,213 A * 2/2000 Harthun ..... F23C 3/00 431/158
6,746,795 B2 * 6/2004 Schwarz ..... H01M 2/1205 429/86
8,267,381 B2 * 9/2012 Schneider ..... B01F 3/0446 261/122.1
8,567,769 B2 * 10/2013 Schneider ..... B01F 3/0446 239/399
8,740,195 B2 * 6/2014 Schneider ..... B01F 3/04106 239/403
8,960,320 B2 * 2/2015 Moyer ..... A62C 4/00 169/48
8,961,892 B2 * 2/2015 Hutter ..... B01F 5/0451 422/129
9,797,595 B2 * 10/2017 Karkow ..... F23D 14/74
2005/0069831 A1 3/2005 St. Charles et al.
2006/0127599 A1 * 6/2006 Wojak ..... C23C 16/45589 427/569
2006/0177729 A1 8/2006 Campau
2010/0227206 A1 9/2010 Campau
2014/0030666 A1 * 1/2014 Pryor ..... F23D 14/54 431/346

FOREIGN PATENT DOCUMENTS

| | | | |
|---|---|---|---|
| CN | 203379533 | U | 1/2014 |
| DE | 2410570 | A1 | 9/1975 |
| DE | 2421407 | B1 | 10/1975 |
| DE | 102006002802 | A1 | 7/2007 |
| EP | 1689010 | A1 | 8/2006 |
| EP | 2066430 | B1 | 4/2012 |

OTHER PUBLICATIONS

International Preliminary Report on Patentability and Written Opinion dated Jan. 16, 2018 in PCT/EP2016/066673 (submitting English translation only).

* cited by examiner

EJECTOR NOZZLE AND USE OF THE EJECTOR NOZZLE

The invention starts from an ejector nozzle having a liquid-carrying duct and a gas-carrying duct, wherein the gas-carrying duct opens into the liquid-carrying duct upstream of an outlet opening.

Ejector nozzles, i.e. ejectors, jet nozzles and ejector jet nozzles, which are referred to overall as ejector nozzles, are used, for example, in reactors in which reactions that require rapid mixing of gas and liquid are carried out. Another area of application is in loop reactors, in which the internal circulatory flow is also produced with the aid of the ejector nozzle. Ejector nozzles can furthermore be used in recirculating gas reactors or gas/liquid absorbers.

In an ejector nozzle, a high-speed liquid flow is generally generated in the liquid-carrying duct. As a result, a vacuum forms at the opening of the gas-carrying duct into the liquid-carrying duct, and the gas is sucked in. Owing to the high speed, the flow is turbulent, and there is rapid mixing of the gas and liquid. The mixture of gas and liquid usually emerges from the ejector nozzle through the outlet opening immediately after the opening of the gas-carrying duct into the liquid-carrying duct.

An ejector nozzle acting as a driving jet nozzle is described in DE-A 24 10 570 or in DE-A 24 21 407, for example. Here, liquid is in each case supplied via a central duct, and gas is supplied via a duct surrounding the central duct. Owing to the high speed of the supplied liquid in the region of the nozzle, the gas is entrained. Turbulent flow arises, leading to rapid mixing.

In order to improve the mixing of the gas and liquid, EP-B 2 066 430 discloses the practice of inserting a swirler into the duct carrying the liquid. The swirler impresses a swirling motion on the liquid before it emerges from the duct. The swirling motion leads to spreading of the jet at the nozzle outlet, as a result of which the jet impinges upon the following gas nozzle in a defined manner and a larger gas/liquid interface can be produced, which leads in turn to more rapid mixing of the gas and liquid.

However, the problem with all ejector nozzles used in reactors is that a rapidly propagating flame front can form in the case of explosive or inflammable reactants. On the one hand, there is the possibility here of the formation of a flame front in the reactor which can blow back in the direction of the ejector nozzle while, on the other hand, there is also the risk that the explosive or inflammable reactants begin to burn in the feed line, and the flame front which thus forms moves in the direction of the reactor. A distinction is usually made between deflagration fronts and detonation fronts. Here, said flame fronts have different speeds, rates of pressure increase and maximum pressures.

Propagation of the deflagration front or detonation front, in particular, can lead to damage of the apparatus and must be attenuated or prevented. Here, the destructive effect in the case of detonation is usually greater by several orders of magnitude than with deflagration, especially in closed systems.

In order to prevent the formation of a flame front, avoiding the formation of a coherent gas phase is known from U.S. Pat. No. 5,726,321, for example. As an alternative, the addition of a chemically inert oil of medium viscosity in regions in which the decomposition of acetylene or of an acetylene-containing gas is initiated is known from U.S. Pat. No. 5,948,945 for the purpose of reducing the ignitability of the substances used.

As an alternative to the known methods, in which the formation of a flame front or of an explosive mixture is prevented by appropriate methodological measures, e.g. the avoidance of a coherent gas phase or the injection of a chemically inert oil, structural measures on the ejector nozzle or on the reactor, by means of which propagation of any flame front which may arise is supposed to be prevented, are also known.

Thus, there is a description in DE-A 10 2006 002 802, for example, of a mixing and injection device which is designed as a two-chamber tube with a fuel-cooled closed tip. To improve the mixing process and to increase heat transfer during the cooling of the closed tip, micro-structured surfaces are provided. Gas and liquid are mixed in an annular gap of the two-chamber tube and are discharged through an annular opening. US-A 2005/0069831 discloses a gas burner in which, downstream of the actual mixing nozzle, there is a permeable barrier which brings about further mixing of fuel and air as it flows through. At the same time, the barrier prevents blowback of the flame front. In the case of the burner described in U.S. Pat. No. 5,098,284, a flame arrester is provided, through which the gas/fuel mixture flows and which is situated upstream of an ignition source by means of which the mixture is ignited.

Flame arresters are known, particularly from burner units. In the case of reactors in which inflammable mixtures are processed and which are provided with an ejector nozzle, methodological measures are generally used in an attempt to prevent the propagation of a flame front. In contrast to burners, no flame fronts generally form in reactors, e.g. jet loop reactors. Conversion takes place without flame formation. Positioning a flame arrester downstream of the actual nozzle, as is the case with burners, has the disadvantage that the additional pressure loss thereby produced greatly reduces the speed of mixing, and therefore the actual function of the ejector nozzle, namely that of bringing about rapid mixing of liquid that is also contained in the reactor, is affected in a disadvantageous way.

When using inflammable starting materials, however, it is not possible to exclude the possibility that they will form flames. It is therefore necessary, by means of suitable measures, to prevent propagation of a possible flame which can lead to damage in the plant. The extent of damage caused by deflagration fronts and detonation fronts can vary and depends on different factors, e.g. pressure, momentum, structure of the surroundings.

If the detonation front entails a greater destructive effect than the deflagration front, the transition from deflagration to detonation can be deliberately prevented, e.g. through the use of a flame arrester.

To avoid damage to apparatus, it is necessary to take precautions which enable the propagation of a flame front, in particular a detonation front, to be prevented.

It is therefore the object of the present invention to provide an ejector nozzle by means of which propagation of a flame front is prevented when used in reactions involving inflammable starting materials.

This object is achieved by an ejector nozzle having a liquid-carrying duct and a gas-carrying duct, wherein the gas-carrying duct opens into the liquid-carrying duct upstream of an outlet opening and wherein an insert acting as a flame arrester is positioned in the gas-carrying duct, wherein the insert is configured in such a way that no gas can flow around the insert.

Owing to the positioning of the flame arrester in the gas-carrying duct, the speed of the medium emerging from the ejector nozzle, which is determined, in particular, by the speed of the liquid, is not significantly reduced. Thus, the function of the driving jet nozzle is not significantly affected.

Reactors which can be fitted with an ejector nozzle according to the invention are all reactors in which rapid mixing of gas and liquid is desired and in which a flow is to be produced. Corresponding reactors are, for example, jet loop reactors or reactors in which a flow for mixing, produced by means of an ejector nozzle, is applied. It is also possible to use tube reactors adjoining the ejector nozzle. However, the use of an ejector nozzle is particularly preferred in a jet loop reactor. A jet loop reactor of this kind is alternatively also referred to as a driving jet reactor.

Since the flames are generally formed in the gas phase and, accordingly, propagation of the flame front may take place especially in the gas phase, the insert acting as a flame arrester is, according to the invention, situated in the gas-carrying duct. The flames can form both in the feed line to the ejector nozzle and in the space into which the ejector nozzle opens. By means of the insert acting as a flame arrester in the gas-carrying duct, propagation of the flame front is effectively prevented in both directions. Here, any desired insert which can prevent flames passing through into the gas-carrying duct is suitable as an insert acting as a flame arrester. In a preferred embodiment, the insert acting as a flame arrester has at least one sintered layer.

Suitable sintered layers are, for example, sintered metal layers or, alternatively, sintered layers made of materials which are sufficiently temperature-stable and, in particular, are inert in relation to the reactants used. Moreover, the material used for the sintered layer should not have any catalytically active effect relative to the reactants used. Suitable materials apart from sintered metals are glass or ceramics, for example. However, sintered metals, especially those based on stainless steel, titanium, nickel and nickel-based alloys, are preferred. Suitable nickel-based alloys are Monel®, Inconel® and Hastelloy®, for example.

Sintered materials, such as sintered glass or ceramics or sintered metals, are porous owing to their manufacture, and therefore they are permeable to gas. The gas supplied via the gas-carrying duct can thus flow through the insert acting as a flame arrester. However, the structure with very small pores prevents any possible passage of flames. Moreover, cooling, which likewise causes a reduction in flame formation, takes place counter to the direction of flow in the insert acting as a flame arrester, and therefore the flame front does not break through the insert acting as a flame arrester.

To obtain additional reinforcement of the insert acting as a flame arrester, especially at high flow velocities and with the propagation of pressure waves, as can occur, for example, owing to a flame front and especially in the case of detonation and to exclude damage due to the high flow velocities and/or pressure waves, it is preferred if the insert acting as a flame arrester additionally comprises a supporting layer. Damage to the insert acting as a flame arrester due to a possible detonation front is also reduced or prevented by the supporting layer. In this case, the sintered layer rests on the supporting layer and is thereby additionally reinforced. In this case, the supporting layer can be arranged in front of the sintered layer or behind the sintered layer in the direction of flow of the gas.

As an alternative, it is also possible for two supporting layers to be provided, wherein one supporting layer is arranged in front of the sintered layer in the direction of flow of the gas and one supporting layer is arranged behind the sintered layer in the direction of flow of the gas.

However, it is preferred to provide two sintered layers, these being arranged in such a way that the insert acting as a flame arrester comprises a first sintered layer, a supporting layer and a second sintered layer in the direction of flow of the gas through the insert acting as a flame arrester.

The supporting layer is preferably a metal layer, in which openings through which the gas can flow are formed. In this case, the openings are large enough to minimize the pressure loss due to the supporting layer. The openings are usually designed as bores in the supporting layer. The size of the openings, e.g. the diameter of the bores, should be chosen in such a way that the sintered metal of the sintered layer is not deformed during operation and pressed into the bores, for example. Otherwise, deformation of the sintered layer could give rise to a blockage, noticeably slowing or even completely blocking the gas flow. The number of openings must be sufficiently large to enable the gas to flow through the supporting layer without a noticeable loss of speed.

The same material is preferably used as a material for the sintered layer and for the supporting layer. However, it is also possible to manufacture the sintered layer and the supporting layer from different materials. Metals such as stainless steel, titanium and nickel-based alloys are particularly preferred as materials for the supporting layer. In contrast to glass and ceramics, these are elastically deformable and are therefore less susceptible to breaking.

In one embodiment of the invention, the liquid-carrying duct is a central duct and the gas-carrying duct surrounds the liquid-carrying duct. As an alternative, however, it is also possible for the gas-carrying duct to be the central channel, which is surrounded by the liquid-carrying duct. However, the liquid-carrying duct is preferably the central duct. The gas-carrying duct can be designed as an annular gap and can completely surround the liquid-carrying duct. As an alternative, however, it is also possible for a plurality of gas-carrying ducts which surround the liquid-carrying duct to be provided. In this case, each gas-carrying duct generally forms a circular segment, a plurality of adjacent gas-carrying ducts thus surrounding the central duct. In the case of a configuration with a plurality of gas-carrying ducts, the gas-carrying ducts can alternatively have any desired cross section. Here, the gas-carrying ducts are arranged annularly around the central duct. In this case, the spacing between the gas-carrying ducts can be equidistant. However, it is also possible for the spacings between the gas-carrying ducts to be different. In the case of a plurality of gas-carrying ducts, however, it is preferred if the central axes of the ducts are situated on a line which surrounds the central duct equidistantly and the spacing between the individual gas-carrying ducts is likewise equidistant. However, it is particularly preferred if only one gas-carrying duct is provided, surrounding the central liquid-carrying duct annularly.

In addition to an embodiment having a central liquid-carrying duct and a plurality of gas-carrying ducts, it is also possible to provide a plurality of liquid-carrying ducts which are surrounded by a gas-carrying, preferably annular, duct. It is also possible to provide a plurality of liquid-carrying and a plurality of gas-carrying ducts. In this case, it is in each case preferred that the liquid-carrying ducts are surrounded by the at least one gas-carrying duct. The liquid-carrying ducts can have any desired cross-sectional shape, the liquid-carrying ducts preferably being circular. In a preferred embodiment having a plurality of liquid-carrying ducts, these are arranged uniformly around a central point, wherein it is additionally possible for a central duct to be provided, around which the other ducts are arranged. In order to obtain good functioning, however, it is always preferred to arrange the at least one gas-carrying duct around the at least one liquid-carrying duct. However, it is also possible to interchange the at least one gas-carrying duct and the at least one liquid-carrying duct, with the result that the at least one liquid-carrying duct surrounds the at least one gas-carrying duct.

In order to improve the mixing of gas and liquid, it is advantageous if a swirler is accommodated in the liquid-carrying duct. By means of the swirler, a rotational movement is impressed upon the liquid flow, thereby dividing the liquid jet and improving mixing with the gas. Suitable positions for the swirler and suitable configurations for the swirler are described in EP-B 2 066 430, for example.

In order furthermore to obtain good mixing of the gas/liquid jet leaving the ejector nozzle with the liquid in the reactor, it is furthermore possible to arrange a momentum exchange tube with or without a lateral entry adjoining the driving jet nozzle. A diffuser is then normally arranged adjoining the momentum exchange tube. The gas/liquid mixture leaving the ejector nozzle enters the momentum exchange tube and, via the lateral entry, sucks in liquid from the reactor. Owing to the high speed and the resulting turbulence, the liquid sucked in is mixed with the gas/liquid mixture in the momentum exchange tube and the subsequent diffuser. The mixture produced in this way then enters the reactor from the diffuser.

To ensure that no flames can enter the gas-carrying duct counter to the direction of flow of the gas if a flame front forms and the flame front propagates, it is necessary that all the gas should flow through the insert acting as a flame arrester. To achieve this, said insert is configured in such a way that no gas can flow around the insert.

In one embodiment, the insert acting as a flame arrester is of cylindrical configuration and is arranged parallel to the direction of flow of the gas in the gas-carrying duct, with the result that the gas changes direction of flow to flow through the insert acting as a flame arrester. By virtue of the cylindrical configuration, two annular gaps are formed. One between the inner wall of the gas-carrying duct and the insert acting as a flame arrester and one between the insert acting as a flame arrester and the outer wall of the gas-carrying duct.

To ensure that no gas can flow around the insert acting as a flame arrester, the annular gap into which the gas flows after flowing through the insert acting as a flame arrester is closed with respect to the gas-carrying duct. For this purpose, it is possible, for example, to provide an annular wall in the gas-carrying duct on the side facing the gas inlet, said wall resting by means of one side on the inner wall of the gas-carrying duct and resting by means of the other side on the insert acting as a flame arrester. By virtue of the annular wall, no gas can flow into the annular gap between the insert acting as a flame arrester and the inner wall of the gas-carrying duct without flowing through the insert acting as a flame arrester.

If, as an alternative, the gas flows through the insert acting as a flame arrester from the inside outward, the annular wall is configured in such a way that it rests on the outer wall of the gas-carrying duct and ends on the inside with the insert acting as a flame arrester. As a result, the gas flows from the inlet into the annular gap between the inner wall of the gas-carrying duct and the insert acting as a flame arrester, through the insert acting as a flame arrester into the annular gap between the insert acting as a flame arrester and the outer wall of the gas-carrying duct and, from there, to the outlet opening from the gas-carrying duct into the liquid-carrying duct.

To ensure that no gas can flow through the annular gap connected to the inlet for the gas, past the insert acting as a flame arrester, to the outlet opening of the gas into the liquid-carrying duct, the annular gap connected to the inlet for the gas is closed on the side facing the outlet opening of the insert acting as a flame arrester.

The annular gap facing the outlet opening is preferably configured in such a way that thermal or electric ignition of the gas does not lead to a transition from deflagration to detonation in the region of the annular gap facing the outlet opening. In this case, the ratio of the axial length of the annular gap to the radial gap width is derived from the detonation initiation distance. Depending on the explosive gas used, the ratio of the axial length of the annular gap to the radial gap width is less than 40 to 1 and the ratio of the circumferential length to the radial gap width is less than 80 to 1, for example, given an initial pressure of less than 30 bar (abs.), an initial temperature of less than 200° C. and a mean initial flow velocity of the inflammable gas of less than 20 m/s. Suitable ratios for a pipe are described, for example, in "Experimental determination of the static equivalent pressure of detonative decompositions of acetylene in long pipes and Chapman-Jouguet pressure ratio", Hans-Peter Schildberg, Conference: Proceedings of ASME 2014 Pressure Vessels and Piping Division, Conference ASME/PVP, Jul. 20-24, 2014, Anaheim, Calif., USA. PVP2014-28197. These can be used for estimation in an annular gap, wherein the ratios chosen for an annular gap can be larger than for a pipe.

In an alternative embodiment, the insert acting as a flame arrester is in the form of a disk and is arranged perpendicularly to the direction of flow of the gas in the gas-carrying duct. In this case, the insert acting as a flame arrester rests by means of one side on the inner wall of the gas-carrying duct and by means of the other side on the outer wall of the gas-carrying duct. This avoids a situation where gas can flow past the insert acting as a flame arrester.

Since the temperature rises when a flame front occurs in the ejector nozzle, it is advantageous to detect the temperature in the ejector nozzle. Here, temperature detection is preferably carried out in the gas space downstream of the flame arrester and ahead of the opening of the gas-carrying duct into the liquid-carrying duct, in particular immediately after the flame arrester in the direction of flow. A change in temperature makes it possible, in particular, to infer that the process is no longer proceeding as envisaged. In particular, a sudden increase in temperature indicates that the gas has begun to burn and that initially a stationary flame has formed. This can lead to coking of surfaces. Moreover, seals or materials, particularly the sintered metal, may be damaged by a stationary flame owing to the high temperatures. Through the detection of the stationary flame, it is possible to take damage prevention measures at an early stage. For this purpose, for example, it is possible first of all to interrupt the supply of gas and liquid or to change the velocity. In order to detect the temperature, it is possible, for example, to arrange a temperature sensor in the region of the insert acting as a flame arrester. Any desired temperature sensor known to those skilled in the art which is not damaged even in the event of flame formation and the temperatures which arise in that case can be used as a temperature sensor here. Suitable temperature sensors are thermocouples, for example, e.g. nickel-chromium/nickel thermocouples, iron/copper-nickel thermocouples or platinum-rhodium/platinum thermocouples, or even platinum measurement resistors.

To suppress flame formation, it is preferred if additive injection is provided in the region of the insert acting as a flame arrester. The quantity of the additive is chosen so that wetting of the surfaces downstream of the insert acting as a flame arrester is achieved. Preferably, the quantity of the additive is chosen so that 20 to 100% of the surface, preferably 50 to 100% of the surface is wetted and, in particular, 80 to 100%. The nozzles by means of which the additive is injected are preferably configured in such a way that the additive is added in a conical spray or as a jet. The addition of the additive ensures desensitization of any possible thermal and/or chemical ignition sources, thus enabling ignition of the gas and hence the formation of flames to be reduced or prevented.

Any liquid which is inert with respect to the reactants used and fed in by means of the ejector nozzle is suitable as an additive. The suitable additives always depend on the reactants fed in and can also include the products produced in the reaction, for example.

When the ejector nozzle is used in reactions to which acetylene or ethene is supplied as a gas, white oils, that is to say paraffin oils, are suitable as additives, for example. Further suitable oils are polyolefin oils, ester oils or silicone oils. However, white oils are preferred. Suitable additives are also described in U.S. Pat. No. 5,948,945, for example.

To ensure that uniform gas flow is obtained, particularly in the case of the gas-carrying duct annularly surrounding the central liquid-carrying duct, it is advantageous if the gas-carrying duct contains a packing upstream of the insert acting as a flame arrester. In this case, the packing should completely cover the insert acting as a flame arrester. In addition, the packing prevents the full force of the detonation front impinging on the insert acting as a flame arrester in the event of a detonation. The demands on the pressure resistance of the insert acting as a flame arrester are thereby reduced. In designing the stability, only the pressure which arises during a deflagration need be taken into account, not the pressure which arises during a detonation. In the case of a detonation, there is the possibility that the packing will be damaged, however. Before restarting the process, this should therefore optionally be replaced. Any suitable structured or random packing can be used as a packing. A random packing is built up from packing elements, for example. In this case, the packing is configured in such a way that the pressure drop produced is as small as possible. Pall® rings or Raschig® rings are suitable as packing elements for a random packing, for example. As an alternative, it is also possible to use balls as packing elements or to use a sintered material. The advantage of Pall® rings or Raschig® rings is the small pressure loss during flow through the packing and the low density of said packing. However, there is the risk that said rings will collapse in the event of a detonation, making it significantly more difficult to empty the ejector nozzle after a possible detonation in order to replace the packing. The advantage of balls is that they can be replaced easily, even after a detonation, although they have the disadvantage of a relatively high density. Moreover, the pressure loss during flow through the packing in normal operation is greater than with Pall® rings or Raschig® rings.

The material of the packing must be compatible with the material of the insert acting as a flame arrester and with the gas at the pressures and temperatures which occur. It is preferable to use the same material as a material for the packing is that also used for the sintered layer of the insert acting as a flame arrester. Preferred materials in this context are metals which do not react with the gas and do not exhibit any catalytic action since glass or ceramics are ground down owing to the gas flow and the vibrations produced by the compressor.

The ejector nozzle according to the invention is preferably used in an apparatus for bringing gas and a liquid phase into contact, wherein the gas phase is explosive. The apparatus for bringing gas and a liquid phase into contact is preferably a jet loop reactor, a circulating gas reactor, a bubble column or a trickle bed in a stirred tank. As an alternative, however, use in any other desired reactor in which a gas/liquid reaction is carried out is conceivable. Another area of application of an ejector nozzle of this kind is in absorbers, in which the intention is to produce rapid mixing through the use of the nozzle.

In a jet loop reactor, the flow produced is such that the liquid contained in the reactor flows upward on one side, is deflected at the phase boundary with respect to a phase boundary lying above the liquid or at the reactor top and flows back downward on the other side, thus producing a flow loop. In general, a jet loop reactor is configured in such a way that the liquid flows centrally upward and flows downward at the edge or flows upward at the edge and downward at the center. This is achieved through appropriate positioning of the ejector nozzles. If the liquid is supposed to flow upward centrally, at least one ejector nozzle is arranged centrally in the lower region of the reactor in such a way that the flow leaving the ejector nozzle is directed upward. As an alternative, it is also possible to arrange a plurality of ejector nozzles annularly around the central region in the upper region in such a way that the flow leaving the ejector nozzle is directed downward. If the liquid is supposed to flow centrally downward and to flow upward at the edge, either at least one ejector nozzle is arranged centrally in the upper region with a downward-directed outlet opening or a plurality of ejector nozzles with upward-directed outlet openings are arranged annularly in the lower region of the reactor. In order to assist the flow in a loop, it is furthermore advantageous to insert within the reactor a tube around which the liquid flows.

The ejector nozzle according to the invention can be used in all reactions in which at least one highly inflammable or explosive gas is used. Corresponding reactions are, for example, all reactions in which acetylene is used as a reagent. These include ethynylation reactions, such as the production of propargyl alcohol or butinediol, vinylation reactions of n-butanol, cyclohexanol, ethylene, glycol, butanediol, imidazole, diethylene glycol, cyclohexanedimethanol, methyl triethylene glycol, pyrrolidone and the production of acetaldehyde, vinyl chlorides, vinyl acetates, vinyl ethers, vinyl-phenyl ethers or vinyl sulfides, or carbonylation reactions, such as the production of acrylic acid or ethyl acrylate.

Other reactions in which the ejector nozzle according to the invention can be used are those in which ethylene oxide or ethene are used as reagents. These include, for example, the production of ethylene glycols by conversion of ethylene oxide with water, the production of ammonia by conversion of ethylene oxide with ethanolamines, of alkylamines by conversion of ethylene oxide with alkyl alkanolamines, of (alkyl)phenol by conversion of ethylene oxide with alkylphenol polyglycol ethers, of alcohols by conversion of ethylene oxide with glycol ethers and of fatty alcohols by conversion of ethylene oxide with fatty alcohol polyglycol ethers.

Other suitable reactions are the conversion of ethylene with chlorine to give dichloroethane and of ethylene with acetic acid and oxygen to give vinyl acetate. The ejector can furthermore also be used for alkoxylation reactions.

The pressure of the gas and/or of the liquid which are transported through the ejector nozzle is generally in a range of from 0.1 to 100 bar (abs.) and the temperature of the gas and/or of the liquid is generally in a range of from −50 to 300° C. Here, the pressure and temperature are dependent on the process in which the ejector nozzle is used and furthermore on the pressure and temperature in the reactor.

Embodiments of the invention are shown in the figures and are explained in detail in the following description.

Figure 1:
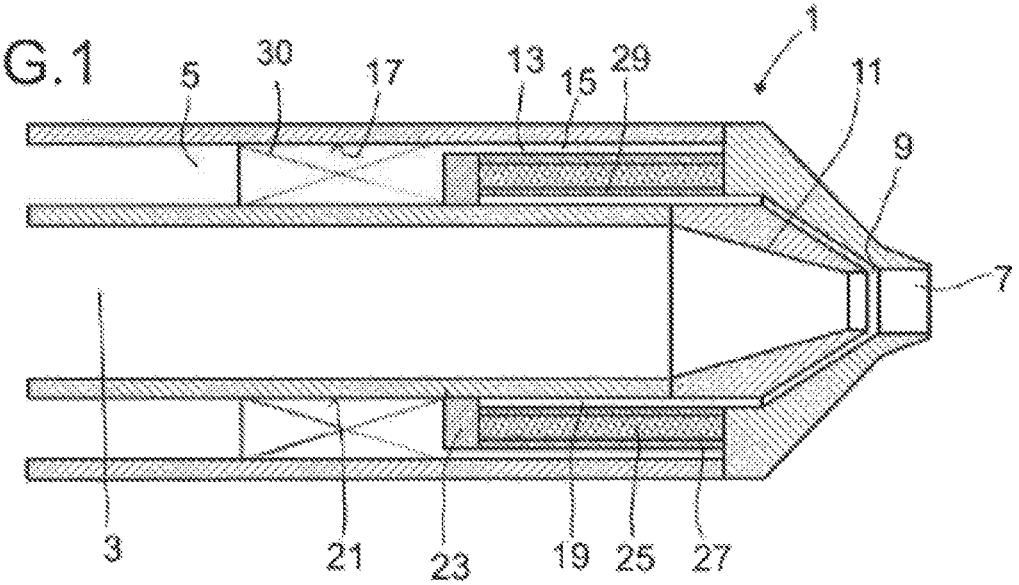
FIG. 1 shows an ejector nozzle having a cylindrical insert, which is arranged parallel to the direction of flow of the gas and acts as a flame arrester.

An ejector nozzle 1 comprises a liquid-carrying duct 3 and a gas-carrying duct 5. In the embodiment shown here, the liquid-carrying duct 3 extends centrally in the ejector nozzle 1, and the gas-carrying duct 5 surrounds the liquid-carrying duct 3. As an alternative, however, any other desired arrangement of the liquid-carrying duct 3 and the gas-carrying duct 5 is also possible. For example, the central duct can also be a gas-carrying duct, and the duct surrounding the central duct can also be a liquid-carrying duct. Moreover, provision can also possible be made, instead of having one surrounding duct, for the central duct to be surrounded by a plurality of ducts extending annularly around the central duct. However, the embodiment shown here is preferred.

The gas-carrying duct 5 opens into the liquid-carrying duct 3 upstream of an outlet opening 7, wherein the liquid-carrying duct has a diameter constriction 11 upstream of the opening 9 of the gas-carrying duct. Owing to the diameter constriction, the speed of the liquid is increased before it emerges from the ejector nozzle 1 through the outlet opening 7. During this process, a vacuum is formed in the region of the opening 9 of the gas-carrying duct, and the gas is sucked in by the liquid. At the same time, the speed is such that good mixing of gas and liquid is achieved. To improve mixing, it is possible to attach a momentum exchange tube (not shown here) to the opening 9. The momentum exchange tube preferably has openings through which liquid surrounding the momentum exchange tube is sucked in. This liquid is mixed with the mixture of gas and liquid emerging from the opening 9. The momentum exchange tube is then generally adjoined by a diffuser, in which the speed is reduced and pressure is built up.

In order to avoid propagation of a flame front into the gas-carrying duct 5 when using explosive gases or to prevent the flame front entering the reactor in the case of ignition of the gas in the region of the gas-carrying duct 5, an insert 13 acting as a flame arrester is provided in the region of the gas-carrying duct 5. In the embodiment shown in FIG. 1, the insert 13 acting as a flame arrester is of cylindrical configuration and is arranged parallel to the main direction of flow of the gas in the gas-carrying duct 5. In this case, the insert 13 acting as a flame arrester is positioned in such a way that a first annular gap 15 is formed between the outer wall 17 of the gas-carrying duct 5 and the insert 13 acting as a flame arrester and a second annular gap 19 is formed between the inner wall 21 of the gas-carrying duct 5 and the insert 13 acting as a flame arrester.

To ensure that all the gas must flow through the insert 13 acting as a flame arrester and that no gas can flow past said insert, the second annular gap 19 is closed with respect to the gas-carrying duct 5 on the side facing away from the outlet opening 7. For this purpose, it is possible, for example, to insert a disk 23, which rests by means of one side on the inner wall 21 of the gas-carrying duct 5 and by means of the other side on the insert 13 acting as a flame arrester.

In operation, the gas flows through the gas-carrying duct into the first annular gap 15, from the first annular gap, through the insert 13 acting as a flame arrester, into the second annular gap 19 and, from there, onward to the opening 9 of the gas-carrying duct 5 into the liquid-carrying duct 3.

In the embodiment shown here, the insert 13 acting as a flame arrester comprises a supporting layer 25, a first sintered layer 27 and a second sintered layer 29, wherein the construction of the insert 13 acting as a flame arrester is configured in such a way that the gas first of all flows through the first sintered layer 27, then through the supporting layer 25 and, after this, through the second sintered layer 29. In this arrangement, the sintered layers 27, 29 each rest on the supporting layer 29. Finally, the gas carrying duct 5 comprises packing elements 30 upstream of the insert 13.

Figure 2:
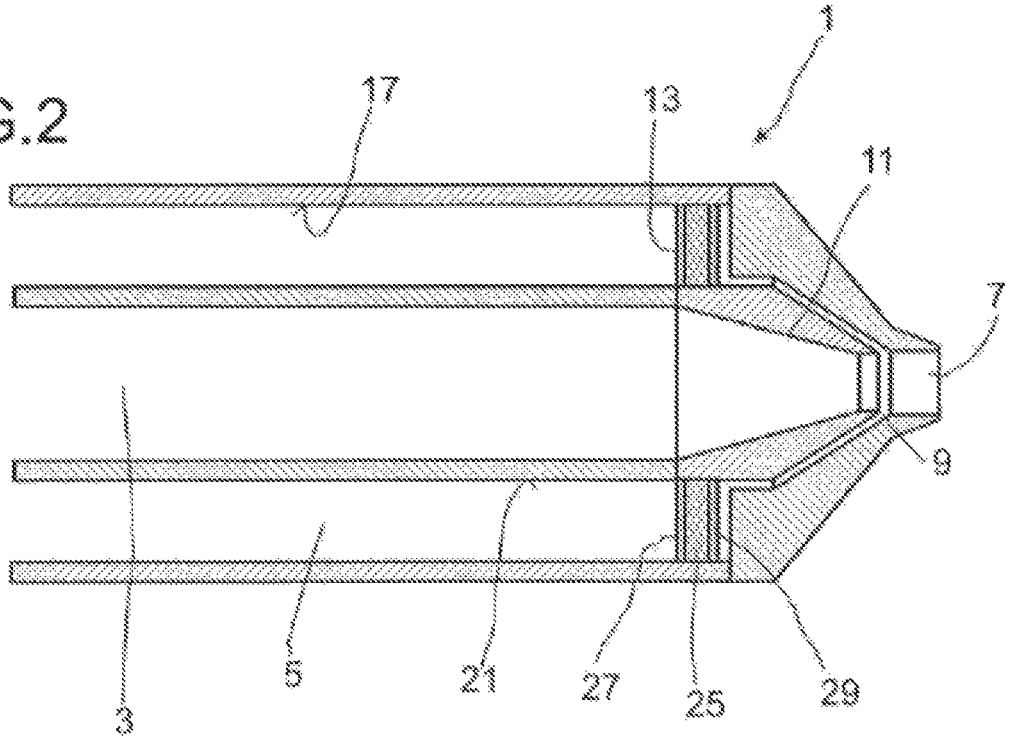
FIG. 2 shows an ejector nozzle having an insert acting as a flame arrester in the form of a disk.

An ejector nozzle having an insert acting as a flame arrester in the form of a disk is shown in FIG. 2.

In contrast to the embodiment shown in FIG. 1, the insert 13 acting as a flame arrester in the embodiment shown in FIG. 2 is not of cylindrical design and accommodated in the gas-carrying duct parallel to the main direction of flow of the gas but is in the form of a disk. Here, the insert 13 acting as a flame arrester rests in each case on the inner wall 21 and the outer wall 17 of the gas-carrying duct. In this case, the first sintered layer 27 is situated on the incident flow side and is aligned perpendicularly to the main direction of flow of the gas. In corresponding fashion, the supporting layer 25 and the second sintered layer 29 are aligned perpendicularly to the main direction of flow of the gas in the gas-carrying duct 5. By virtue of the fact that the insert 13, which is configured as a disk and acts as a flame arrester, rests both on the inner wall 21 and on the outer wall 17 of the gas-carrying duct 5, no gas can flow around the insert 13 acting as a flame arrester. All the gas must flow through the insert 13 acting as a flame arrester.

Figure 3:
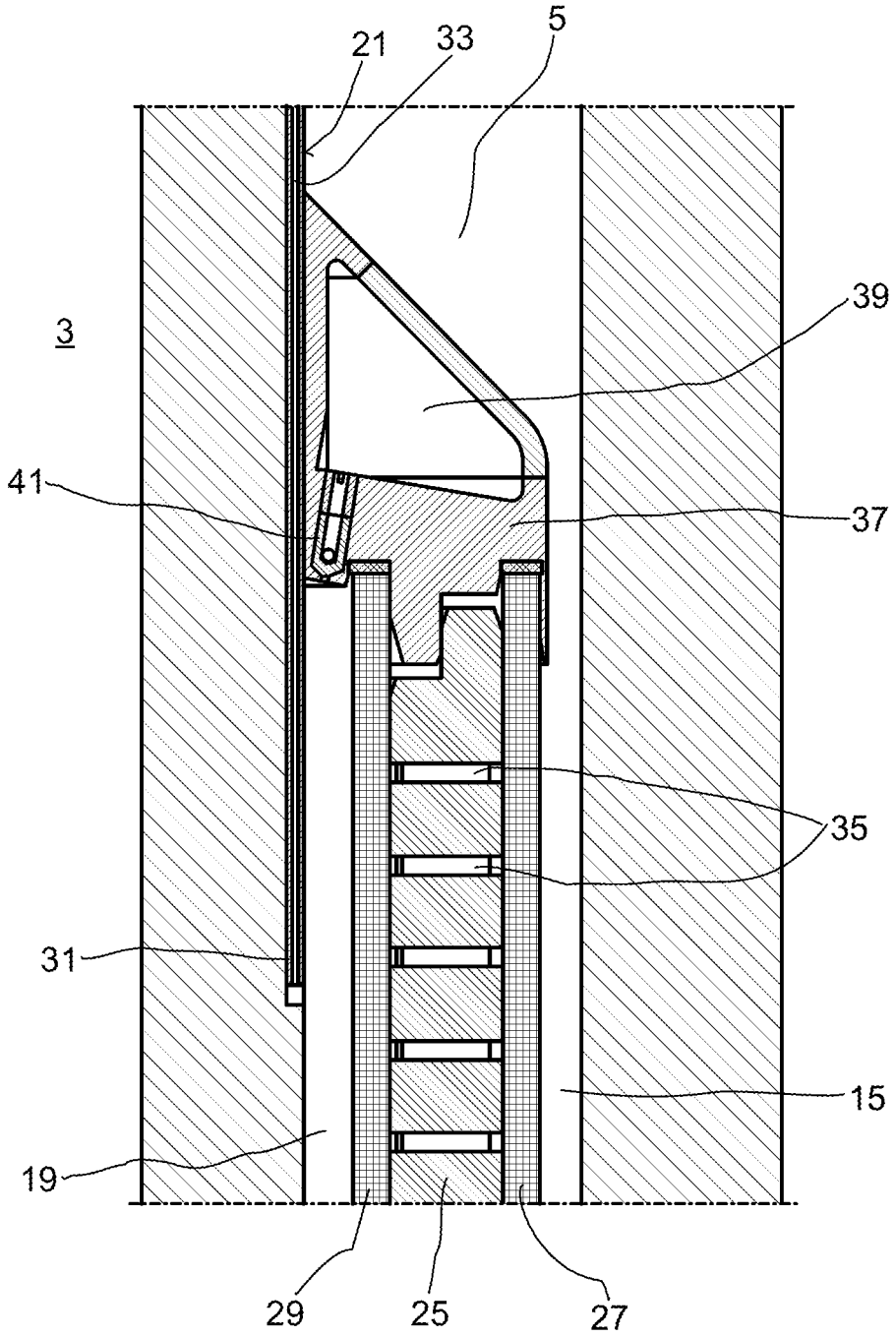
FIG. 3 shows a detail of an ejector nozzle with additive injection and a temperature sensor.

FIG. 3 shows a detail of an ejector nozzle having additive injection and a temperature sensor.

In the detail shown here, the insert 13 acting as a flame arrester is of cylindrical configuration and positioned parallel to the flow of gas in the gas-carrying duct 5, as in FIG. 1.

To enable the gas to flow through the insert 13 acting as a flame arrester and to obtain sufficient stability in the insert 13 acting as a flame arrester, the supporting layer 25 is configured in the form of a ring having bores 35. Owing to the bores 35 the pressure loss in the supporting layer 25 is very much lower than the pressure loss in the sintered layers 27, 29, in which the gas must flow through the pores contained therein. In order to keep the total pressure loss as small as possible, it is therefore advantageous to make the sintered layers 27, 29 as thin as possible. In order nevertheless to obtain a stable insert 13 acting as a flame arrester, the supporting layer is necessary. Since sintered layers are generally brittle, there is the risk that a sintered layer will break without an additional supporting layer, owing to the pressure differences and mechanical stresses in the gas-carrying duct 5, especially if a flame front forms or especially if the gas detonates, and therefore that the effect as a flame arrester will no longer be present.

For temperature measurement in the region of the insert 13 acting as a flame arrester in order, for example, to detect the formation of a flame front which may impair the operation of the insert 13, it is possible, as shown here, to insert a temperature sensor 31. For this purpose, as shown here, it is possible, for example, to make a groove 33 in the inner wall 21 delimiting the gas-carrying duct 5, for example, in which groove the temperature sensor 31 is accommodated. The temperature sensor 31 can be fixed in the groove by bonding it in with adhesive that is stable relative to the conditions prevailing in the gas-carrying duct 5 or by soldering, for example. To mount the temperature sensor, it is also possible to insert a supporting tube into the groove 33 and to guide the temperature sensor in the supporting tube. Care should be taken here to ensure that the lead-through is sealed off relative to the gas-carrying duct 5 to ensure that no gas can flow into the supporting tube. Sealing is also necessary if the temperature sensor 31 is inserted directly into the groove 33 to ensure that no gas can flow out via the guide for the temperature sensor 31.

In order to detect flame formation in time, it is preferred here if the temperature sensor projects into the second annular space 19, as shown here.

The risk of flame formation, e.g. as a stationary flame, can furthermore be reduced or suppressed by means of additive injection. By means of the additive injection, possible ignition sources, e.g. solid deposits, are desensitized.

In the embodiment shown here, the insert 13 acting as a flame arrester is fixed by means of a holder 37, wherein a duct 39, through which a liquid additive, e.g. a white oil, polyolefin oil or silicone oil, can be fed in, is formed in the holder 37. Branching off from duct 39 are nozzles 41, through which the liquid additive is injected into the second annular gap 19. In this case, the nozzles 41 can be in the form of bores in the holder 37. Injection of the liquid additive into the first annular gap 15 or the gas-carrying duct 5 upstream of the insert 13 acting as a flame arrester is not desired since the liquid additive would flow only very slowly through the sintered layers and would thus collect in the first annular gap 15 and flood the latter. This can lead to malfunctioning of the ejector nozzle.

If, as illustrated in FIG. 2, the insert 13 acting as a flame arrester is embodied in the form of a disk, it is possible, for example, to form a duct for the supply of the additive around the outside of the ejector nozzle and to inject the liquid additive into the region downstream of the insert 13 acting as a flame arrester through bores in the outer wall of the gas-carrying duct 5 downstream of the insert 13 acting as a flame arrester, said bores being connected to the externally formed duct for supplying the additive.

LIST OF REFERENCE SIGNS

1 ejector nozzle
2 liquid-carrying duct
5 gas-carrying duct
7 outlet opening
9 opening of the gas-carrying duct 5 into the liquid-carrying duct 3
11 diameter constriction
13 insert acting as a flame arrester
15 first annular gap
17 outer wall
19 second annular gap
21 inner wall
23 disk
25 supporting layer
27 first sintered layer
29 second sintered layer
30 packing elements
31 temperature sensor
33 groove
35 bore
37 holder
39 duct
41 nozzle

The invention claimed is:

1. An ejector nozzle, comprising:

a liquid-carrying duct and a gas-carrying duct, wherein the gas-carrying duct opens into the liquid-carrying duct upstream of an outlet opening, such that a high-speed liquid flow is generated in the liquid-carrying duct and a vacuum forms at an opening of the gas-carrying duct into the liquid-carrying duct, by which gas is sucked into the liquid-carrying duct, wherein the liquid-carrying duct comprises a diameter constriction upstream of the opening of the gas-carrying duct into the liquid-carrying duct, wherein the outlet opening has a cross-sectional area smaller than a cross-sectional area of the liquid-carrying duct upstream of the diameter constriction, wherein an insert acting as a flame arrester is positioned in the gas-carrying duct upstream of where the gas-carrying duct opens into the liquid-carrying duct, wherein the insert is configured in such a way that a whole gas stream passes through the flame arrester and no gas flows around the insert, and wherein said gas-carrying duct comprises at least one gas selected from the group consisting of acetylene, ethylene oxide and ethene.

2. The ejector nozzle of claim 1, wherein the insert acting as a flame arrester comprises at least one layer.

3. The ejector nozzle of claim 2, wherein the insert acting as a flame arrester additionally comprises a supporting layer.

4. The ejector nozzle of claim 1, wherein the insert acting as a flame arrester comprises a first sintered layer, a supporting layer and a second sintered layer in a flow direction of gas through the insert acting as a flame arrester.

5. The ejector nozzle of claim 1, wherein the liquid-carrying duct is a central duct and the gas-carrying duct surrounds the liquid-carrying duct.

6. The ejector nozzle of claim 5, wherein the insert acting as a flame arrester is of cylindrical configuration and is arranged parallel to a flow direction of gas in the gas-carrying duct so that the gas changes direction of flow to flow through the insert acting as a flame arrester.

7. The ejector nozzle of claim 5, wherein the insert acting as a flame arrester is in a form of a disk and is arranged perpendicularly to a flow direction of gas in the gas-carrying duct.

8. The ejector nozzle of claim 1, wherein a temperature sensor is arranged in a region of the insert acting as a flame arrester.

9. The ejector nozzle of claim 1, wherein an additive injection is provided in a region of the insert acting as a flame arrester.

10. The ejector nozzle of claim 9, wherein the additive injection is an injection of white oil.

11. The ejector nozzle of claim 1, wherein the gas-carrying duct upstream of the insert acting as a flame arrester contains packing elements.

12. A method for contacting a gas phase with a liquid phase, the method comprising:

bringing the gas phase and the liquid phase into contact in an apparatus comprising the ejector nozzle of claim 1, wherein the gas phase is explosive.

13. The method of claim 12, wherein the apparatus is a jet loop reactor, an absorber, a circulating gas reactor, a bubble column, or a trickle bed in a stirred tank.

14. The method of claim 12, wherein the apparatus is a jet loop reactor or a circulating gas reactor, and acetylene, ethene, or ethylene oxide reacts in the apparatus as a gaseous reagent.

15. The ejector nozzle of claim 1, wherein the insert acting as a flame arrester is positioned such that a first annular gap is formed between an outer wall of the gas-carrying duct and the insert acting as a flame arrester and a second annular gap is formed between an inner wall of the gas-carrying duct and the insert acting as a flame arrester.

16. The ejector nozzle of claim 4, wherein said first sintered layer and/or said second sintered layer is a sintered material selected from a sintered glass, a ceramic or a sintered metal.

* * * * *